US005297849A

United States Patent [19]

Chancellor

[11] Patent Number: 5,297,849

[45] Date of Patent: Mar. 29, 1994

[54] VERTICALLY ADJUSTABLE SWIVEL SUPPORT WITH LOCK FOR USE WITH SEATING

[76] Inventor: Charles W. Chancellor, P.O. Box 15, Midland, Tex. 79702

[21] Appl. No.: 772,672

[22] Filed: Oct. 7, 1991

[51] Int. Cl.[5] ..... A47C 1/06

[52] U.S. Cl. ..... 297/344.12; 297/344.22

[58] Field of Search ..... 297/349, 338, 339, 345, 297/347, 348, 284 F; 248/423, 418, 404–414; 114/363, 194; 108/144–148

[56] References Cited

U.S. PATENT DOCUMENTS

| | | | |
|---|---|---|---|
| 1,275,624 | 8/1918 | Sopwith | 248/425 |
| 1,789,821 | 1/1931 | Leffingwell | 297/284 X |
| 2,010,290 | 8/1935 | Campbell | 108/148 |
| 2,242,138 | 5/1941 | Mumo | 297/217 |
| 2,604,925 | 7/1952 | Swift | 248/407 |
| 3,856,252 | 12/1974 | Regis | 297/348 X |

*Primary Examiner*—Laurie K. Cranmer

*Attorney, Agent, or Firm*—Jacobson, Price, Holman & Stern

[57] ABSTRACT

A swivel support for seating such as a boat chair, various vehicle seats and other types of chairs or seats which can swivel and be vertically elevated or lowered that includes a lock structure which will automatically lock the support in angularly adjusted position about a vertical axis when the support is lowered from its elevated position to its lowered position. Many boats are provided with chairs which can be elevated to provide occupants of the chair with a better position for fishing. Chairs of this type are conventionally capable of being swiveled or rotatable about a vertical axis to enable the occupant to assume different angular positions in relation to the gunwales of the boat for a more effective fishing position. The boat chair lock structure will automatically lock the boat chair against rotation or swivel movement when the boat chair is lowered such as when the boat is underway from one location to another. The lock structure for the chair includes components on the stationary base and the movable component of the chair which interengage in one of a plurality of selected positions about a vertical axis when the boat chair is lowered to lock the boat chair in the selected angular position automatically when the boat chair is lowered.

9 Claims, 2 Drawing Sheets

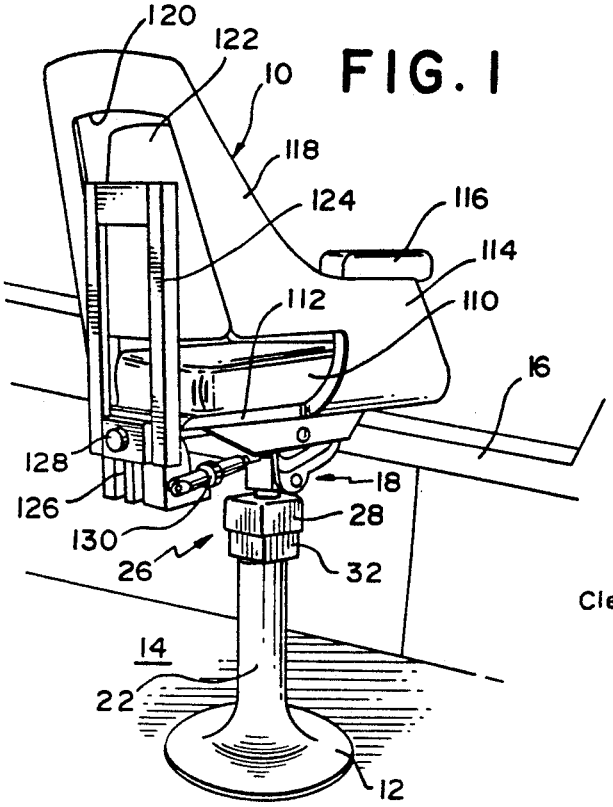
FIG. 1
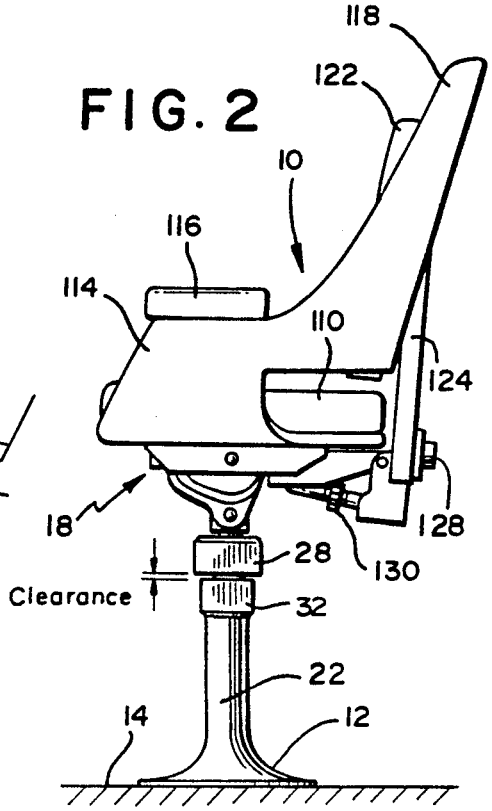
FIG. 2
FIG. 3
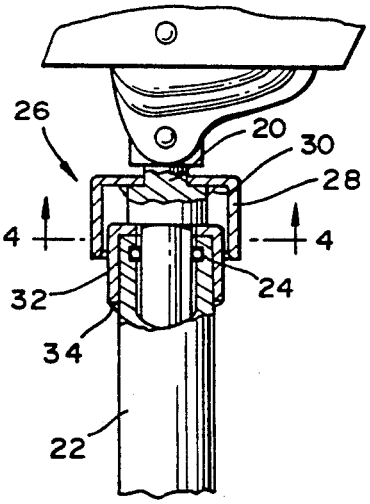
FIG. 4
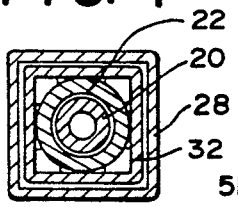
FIG. 6
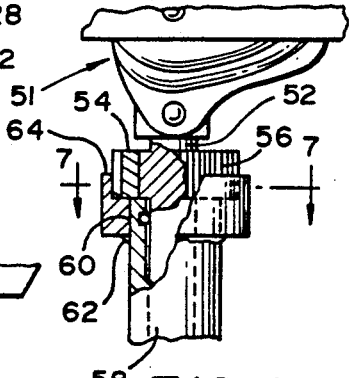
FIG. 5
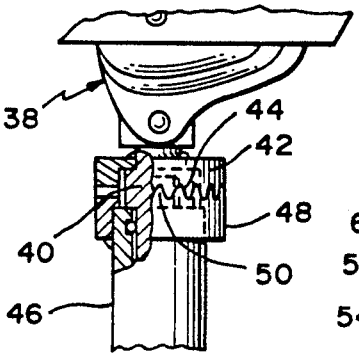
FIG. 7
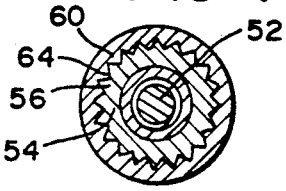

FIG. 8
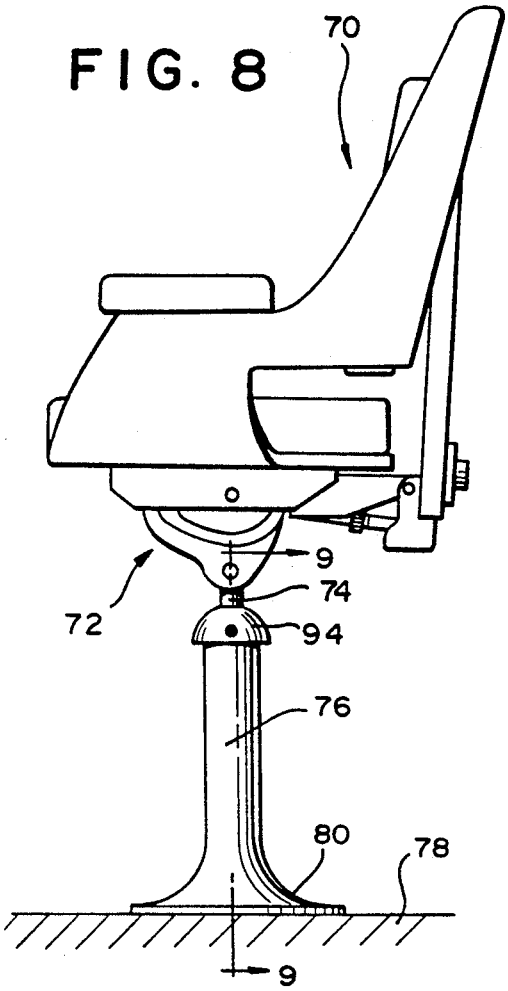
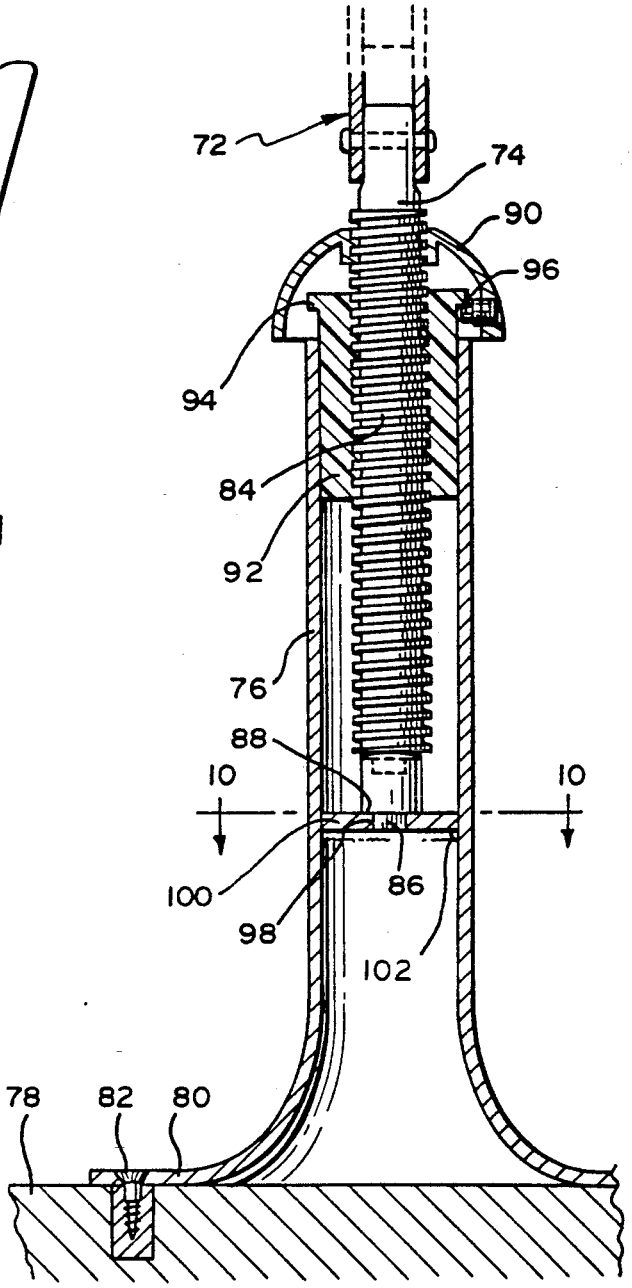
FIG. 9
FIG. 10
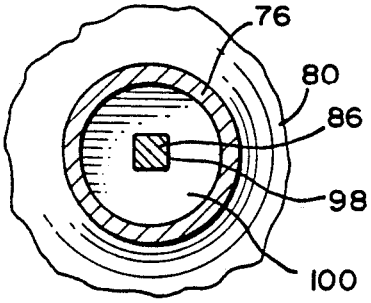

VERTICALLY ADJUSTABLE SWIVEL SUPPORT WITH LOCK FOR USE WITH SEATING

BACKGROUND OF THE INVENTION

1. Field of the Invention

The present invention generally relates to a swivel support for seating such as a boat chair, various vehicle seats and other types of chairs or seats which can swivel and be vertically elevated or lowered and more specifically a swivel support provided with a lock structure which will automatically lock the swivel support in angularly adjusted position about a vertical axis when the support is lowered from its elevated position to its lowered position. Many boats are provided with chairs which can be elevated to provide occupants of the chair with a better position for fishing. Many other swivel chairs and seats can also be elevated or lowered. Boat chairs of this type are conventionally capable of being swiveled or rotated about a vertical axis to enable the occupant to assume different angular positions in relation to the gunwales of the boat for a more effective fishing position. The swivel support of this invention includes a lock structure which will automatically lock the boat chair against rotation or swivel movement when the boat chair is lowered such as when the boat is being driven from one location to another. The lock structure for the chair includes components on the stationary base and the movable component of the chair which interengage in one of a plurality of selected positions about a vertical axis when the boat chair is lowered to lock the boat chair in the selected angular position automatically when the boat chair is lowered.

2. Description of the Prior Art

Boat chairs which can be elevated manually or which are powered by an air lift, gas lift, hydraulic lift or the like are well known and these chairs are also capable of rotating about a vertical axis to enable the occupant to obtain optimum position when fishing. The following U.S. patents relate to developments in this field.

276,830
1,862,755
4,278,289
4,487,452
4,518,139
4,655,632
4,673,155

While the prior patents disclose chairs which are elevatable, capable of swiveling movement and return to a predetermined position when an occupant leaves the chair, the above mentioned patents do not disclose a lock structure in accordance with this invention.

SUMMARY OF THE INVENTION

An object of the present invention is to provide a lock for securing a vertically adjustable swivel support in non-rotatable position when the support is lowered with the lock including components which will automatically engage when the support is lowered to lock the swivel support in non-rotatable position when in its lowered position.

Another object of the invention is to provide a swivel support lock in accordance with the preceding object in which the components which automatically engage when the support is lowered include telescopic square or other polygonal components, axial serrations or teeth, radial serrations or teeth or other shapes and configurations which will provide a positive locking engagement when the support moves to its lowermost position.

A further object of the invention is to provide a swivel support lock associated with a vertically adjustable swivel boat chair or the like which can be manually operated by a screw threaded device or by a gas cylinder or other source of compressed air or gas with the lock device preventing swiveling movement of the chair when it is lowered to enable the occupant of the chair to obtain a desired position when fishing with the chair in elevated position with the occupant of the chair also being stably supported by the chair when it is lowered with the chair then being locked in a desired angular relationship such as facing forwardly, rearwardly or inboard thereby providing a boat chair capable of supporting an occupant in desired positions when fishing o when the boat is underway.

Still another object of the invention is to provide a lock for boat chairs which is simple in construction, easily retrofitted into existing boat chair structures and incorporated into new boat chair structures and which is longlasting and dependable and provides a positive lock for the boat chair.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a gas elevated boat chair utilizing the swivel support lock structure of the present invention.

FIG. 2 is a side elevational view of the boat chair illustrating the clearance between the locking components when the boat chair is in elevated position.

FIG. 3 is a fragmental side elevational view with the chair in lowered position with the locked components being shown in section.

FIG. 4 is a transverse, sectional view taken substantially upon a plane passing along section line 4—4 on FIG. 3 illustrating further structural details of the lock structure.

FIG. 5 is a fragmental side elevational view with portions in section illustrating locking components with axial teeth disposed in meshing engagement.

FIG. 6 is a fragmental side elevational view with portions in section similar to FIGS. 3 and 5 but illustrating another embodiment of locking structure with radial meshing serrations or teeth.

FIG. 7 is a transverse, sectional view taken substantially upon a plane passing along section line 7—7 of FIG. 6 illustrating further structural details of this embodiment of the invention.

FIG. 8 is side elevational view of a manually elevatable chair utilizing the swivel support lock structure of the present invention.

FIG. 9 is a vertical sectional view taken substantially upon a plane passing along section line 9—9 on FIG. 8, on an enlarged scale, illustrating the structural details of the lock structure for the vertically adjustable swivel support.

FIG. 10 is a transverse, sectional view taken substantially upon a plane passing along section line 10—10 on FIG. 9 illustrating the specific structure of the lock plate.

DESCRIPTION OF THE PREFERRED EMBODIMENTS

Referring now specifically to FIGS. 1–4, a boat chair incorporating the swivel support lock structure of the present invention is generally designated by reference numeral 10 and includes a base 12 supported on the deck 14 of a boat adjacent the gunwale 16 with the chair being capable of swivel movement about a vertical axis and vertical movement between an elevated position and a lowered position. The chair includes a supporting frame 18 which includes a depending support stem 20 telescoped into a tubular standard 22 forming part of the base 12. The stem can be extended and retracted by a gas lift or air lift structure in which the stem 20 is provided with a seal 24 which enables air pressure to move the chair to elevated position. Usually, the chair does not move more than approximately 6" when moved between its lowermost position and its uppermost position.

The lock structure illustrated in FIGS. 1–4 is generally designated by reference numeral 26 and includes an inverted square cup-shaped member 28 rigidly affixed to the stem 20 as by welding 30 or the like. Attached to the upper end of the standard 22 is a correspondingly shaped square or polygonal member 32 secured thereto as by welding 34 with the member 32 being slightly smaller in outside dimension as compared to the inside dimension of the member 28 to permit the member 28 to telescope downwardly over the member 32 when the chair is lowered to its lowermost position as illustrated in FIG. 3. When the chair is elevated above its lowermost position as illustrated in FIGS. 1 and 2, there is a clearance between the bottom edge of the member 28 and the upper edge of the member 32 so that these two members are not telescoped and are not locked. Thus, when the chair is elevated, it can swivel in a usual manner but when it is lowered, it will become locked in one of several positions depending upon the shape and configuration of the members 28 and 32. When the members are square as illustrated in FIGS. 1–4, the chair can be locked in any one of four positions such as with the chair facing forwardly, rearwardly, inboard or outboard.

FIG. 5 illustrates another embodiment of the invention in which the chair frame 38 includes a depending stem 40 having a cup-shaped member 42 affixed thereto by welding or the like with the lower axial end of the cup-shaped member including a plurality of teeth or serrations 44. The vertical standard 46 forming part of the base is provided with a cylindrical member 48 attached thereto as by welding or the like with the member 48 including a plurality of teeth or serrations 50 on the axial surface thereof for interlocking engagement with the teeth or serrations 44 when the seat is in lowered position thereby locking the seat in a manner to prevent rotation when the chair is lowered but permitting the chair to swivel when elevated.

FIGS. 6 and 7 illustrate another embodiment of the invention in which the chair frame 51 includes a stem 52 having a cylindrical member 54 rigid therewith with the cylindrical member 54 including radially extending longitudinal serrations or teeth 56 on the periphery thereof. The vertical standard 58 forming part of the base is provided with a cup-shaped, upwardly opening cylindrical member 60 affixed thereto by welding 62 or the like with the upper interior portion of the cup-shaped member 60 including radially extending longitudinal teeth or serrations 64 which extend longitudinally therein for interlocking engagement with the teeth or serrations 56 when the member 54 is telescoped into the cup-shaped member 60 which occurs when the seat has been lowered to its lowest position.

FIGS. 8–10 illustrate a manually elevated chair structure generally designated by reference numeral 70 of conventional construction and which includes a chair frame generally designated by reference numeral 72 having a stem 74 depending therefrom which extends telescopically into a tubular standard 76 attached to a deck 78 or other horizontal surface by an outwardly flared lower end 80 and fastener devices 82 of conventional construction. The stem 74 includes an externally threaded portion 84 which may extend throughout its length. The stem 74 is also o conventional construction except that the lower end of the stem 74 is provided with a projection 86 which extends axially from the end of the step 74 and is of square or other non-circular configuration with the perimeter of the projection being less than the perimeter of the stem 74 to define a shoulder 88 that is defined by that portion of the lower end of the stem 74 outwardly of the projection 86. The stem 74 is vertically elevated by rotation of an internally inverted cup-shaped bell 90 which may be dome-shaped or cylindrical and threadedly engaged with stem 74. A sleeve 92 is rigidly affixed to the standard and guidingly receives the stem 74. The upper end of the sleeve 92 includes an outwardly extending peripheral flange 94. A set screw 96 which extends radially into the bell 90 and under the flange 94 rotatably secures the bell 90 and stem 74 to the standard 76. All of the structure for raising and lowering the chair 70 is conventional except for the projection 86 on the lower end of stem 74. In operation, rotation of the bell 90 moves the stem 74 upwardly or downwardly thus adjusting the elevation of the chair and the chair can swivel normally when in any vertically adjusted position. However, in this form of the invention, when the chair is lowered, so that the stem 74 moves downwardly, the projection 86 will enter an aperture or hole 98 of square or non-circular configuration in a lock plate 100 that is anchored to the interior of the tubular standard 76 as by welding 102 or the like and the chair 70 will then be locked against rotation or swivel movement. Since the chair and stem 74 can swivel as the stem is being lowered, the square or other noncircular configuration of the projection 86 and the hole 98 can be aligned so that rotation of the bell 90 will lower the projection into the hole 98 thus locking the stem 74 and thus the chair 70 from rotation or swivel movement.

As illustrated in FIGS. 1–7, the locking device may be in the form of telescopic square or other correspondingly shaped non-cylindrical members with the members having axial teeth or serrations or radial teeth or serrations which will interlock to provide a positive locking action against rotation when the movable member on the seat is engaged with the stationary member on the chair base. If a square structure is used such as the cup-shaped member 28, the member 32 may be square on in lieu thereof, four equally spaced upwardly projecting rods could be welded to the tubular standard 22 with the rods being received generally in the corners of the square cup-shaped member or box 28. The rods could be equally spaced at 90° around the perimeter of the standard or housing 22 and need only be long enough to engage the vertical height of the cup-shaped member 28 when it is telescoped over the upper end of the member 22. Likewise, rods or beads could be rigidly affixed to a plate or flange on the seat stem which would engage drilled holes in the housing which would lock the seat from rotating even if the boat hits an obstruction such as a log or the like thereby providing stable support for the occupant of the chair.

As illustrated in FIGS. 8–10, a lock structure may be incorporated into a conventional manually screw threaded or jacktype chair elevating and lowering mechanism by adding a square or other non-circular projection on the lower end of the vertically movable and swivelly mounted stem and a plate rigidly welded to the interior of the tubular standard having a central opening therein corresponding in shape to the configuration of the projection to lock the stem and thus the chair from swivelling movement when the stem and chair are in the lowered position by rotation of the bell and releasing the stem for rotation or swivel movement when the bell is rotated to elevate the stem and chair.

The chair structure is constructed of plastic material or weather resistant material and includes a seat cushion 110 supported by a bottom member 112 and upright side pieces 114 terminating at arm rests 116 at the forward ends thereof and extending upwardly to form a back rest 118. The back rest 118 includes an enlarged open area 120 receiving an inset back rest 122 supported by a pivoted frame 124 which is vertically adjustable by slot-like structures 126 and a clamp bolt 128 and angularly adjusted by an adjustment structure 130 to vary the position of the inset back rest in relation to the back rest 118. The seat itself is pivotal and supported by a spring structure of conventional construction which can be adjusted to vary the normal position of the chair and also vary the resistance to pivotal movement of the chair about a transverse axis.

The chair structure including the pivot control is supported for rotational movement about a vertical axis defined by the stem which can be manually elevated by a screw-type jack structure or power operated by a compressed gas cylinder admitting compressed gas into a piston and cylinder arrangement to extend the piston upwardly with the piston being connected to the stem or forming the stem to lift the chair. This enables the occupant of the chair to swivel to any desired position when fishing or performing other tasks while occupying the elevated seat or chair. When the chair is lowered such as when the boat is underway, the chair will automatically lock in a selected position due to the engagement of telescopic polygonal cup-like or box-like members, telescopic engagement of radially extending, longitudinal teeth or serrations, engagement of movable and stationary components having axially facing teeth or serrations, or by engagement of a square projection with a square hole in a rigid lock plate with all of the locking structures enabling the chair to be automatically locked against swiveling o rotational movement when the chair is lowered to its lower-most position either manually or by exhausting the gas lift.

While the vertically adjustable swivel support and locking structure have been illustrated in the drawings with a boat chair, it is pointed out that the structure can be used with any type of seating which involves a seat or chair which can swivel about a vertical axis with the seat or chair being automatically locked to prevent swivelling movement when the seat or chair is lowered and automatically unlocked to permit swivelling movement when the seat or chair is elevated regardless of the mechanism used to vertically adjust the seat or chair.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A lock for a vertically adjustable swivel support which includes a non-rotatable base member and a rotatable member supported from the non-rotatable base member at a rotational interface, said lock comprising a lock member mounted on the non-rotatable base member and a lock member mounted on the rotatable member, said support including manually controlled means to elevate and lower the rotatable member in relation to the base member and maintain the rotatable member in either position solely by said manually controlled means independently of the presence of any other externally applied force on the rotatable member, said lock members including means bridging the rotational interface between lock members when the rotatable member is in lowered position thereby preventing swivel movement of the support.

2. The structure as defined in claim 1 wherein said means bridging the interface includes one of the lock members being constructed in the form of a polygonal cup-shaped member, the other of the lock members being constructed of corresponding polygonal shape for telescopic engagement with the cup-shaped member when the rotatable member is lowered.

3. The structure as defined in claim 2 wherein each of said lock members is of square configuration for telescopic engagement in four, equally spaced positions of the lock members in relation to each other.

4. The structure as defined in claim 1 wherein said means bridging the interface includes axially extending, radial teeth on opposed axial surfaces of the lock members which are interlocked when the rotatable member is lowered.

5. The structure as defined in claim 1 wherein said means bridging the interface includes a stationary lock plate mounted on the non-rotatable base member, said lock plate having a non-circular opening therein, said rotatable member having a projection on a lower end thereof of noncircular configuration corresponding to the shape of the opening and telescoped into the opening in the lock plate when the rotatable member is lowered thereby preventing swivel movement of the support.

6. The structure as defined in claim 1 wherein said swivel support is a chair including a chair frame and the rotatable member depends from said frame and is in the form of a vertically disposed stem capable of rotational movement and vertical adjustment in relation to the base member, said base member including a tubular standard telescopically receiving the stem, said means to elevate said rotatable member in relation to the base member including means interconnecting the tubular standard and stem to vertically elevate and lower the stem and chair frame in relation to the tubular standard.

7. The structure as defined in claim 6 wherein said chair frame includes a chair seat and back rest, said back rest including an enlarged opening, an inset back rest in said opening, means vertically adjustably supporting the inset back rest and angularly supporting the inset back rest to position it in different position in relation to the chair back rest.

8. In a chair comprising a seat for supporting an occupant, means supporting said seat for swivel movement about a generally vertical axis, manually controlled means connected to said seat and supporting means to elevate and lower said set without requiring the weight of a seat occupant, the improvement comprising lock means on said seat and supporting means that automatically locks the seat against rotation when said manually controlled means lowers said seat and automatically permits swivel movement when the seat is elevated, said manually controlled means including manually operated screw thread means interconnecting said seat and supporting means.

9. In a chair comprising a seat for supporting an occupant, means supporting said seat for swivel movement about a generally vertical axis, power controlled means connected to said seat and supporting means to elevate and lower said set without requiring the weight of a seat occupant, the improvement comprising lock means on said seat and supporting means that automatically locks the seat against rotation when said power controlled means lowers said seat and automatically permits swivel movement when the seat is elevated, said power controlled means including a gaseous lift interconnecting said seat and supporting means to power elevate and power lower said seat.

* * * * *